US008113383B2

(12) United States Patent
DeCarlo et al.

(10) Patent No.: US 8,113,383 B2
(45) Date of Patent: Feb. 14, 2012

(54) BIASED PAPER DISPENSING DEVICE

(75) Inventors: Anthony Joseph DeCarlo, Bay Village, OH (US); Curtis Patrick Taylor, Chagrin Falls, OH (US); Jonathan George Erbacher, Twinsburg, OH (US); David George Hudak, Solon, OH (US)

(73) Assignee: Ideastream Consumer Products, LLC, Cleveland, OH (US)

( * ) Notice: Subject to any disclaimer, the term of this patent is extended or adjusted under 35 U.S.C. 154(b) by 316 days.

(21) Appl. No.: 12/481,334

(22) Filed: Jun. 9, 2009

(65) Prior Publication Data

US 2009/0302050 A1 Dec. 10, 2009

Related U.S. Application Data

(60) Provisional application No. 61/059,923, filed on Jun. 9, 2008.

(51) Int. Cl.
*B65D 83/08* (2006.01)

(52) U.S. Cl. ..... 221/279; 221/280; 221/303; 271/145; 271/160

(58) Field of Classification Search ..... 221/45–46, 221/56, 58–59, 226, 279, 280, 303; 271/145, 271/157, 160
See application file for complete search history.

(56) References Cited

U.S. PATENT DOCUMENTS

| | | | | |
|---|---|---|---|---|
| 1,008,130 | A | 11/1911 | Fuerst | |
| 2,273,644 | A * | 2/1942 | Hope | 221/279 |
| 3,107,770 | A | 10/1963 | Short | |
| 3,189,219 | A * | 6/1965 | Holzworth et al. | 221/131 |
| 3,425,595 | A | 2/1969 | Shapira | |
| 3,768,695 | A | 10/1973 | Pearson | |
| 4,252,251 | A | 2/1981 | Ek et al. | |
| 4,258,861 | A | 3/1981 | Traill et al. | |
| 4,273,255 | A | 6/1981 | Overall | |
| 4,428,503 | A | 1/1984 | Martin | |
| 4,530,445 | A * | 7/1985 | Decker | 221/198 |
| 4,707,038 | A | 11/1987 | Voegeli | |
| 4,732,255 | A | 3/1988 | Bullard | |
| 4,799,606 | A * | 1/1989 | Vershbow | 221/280 |
| 4,889,221 | A | 12/1989 | Schlumpf | |
| 5,165,571 | A | 11/1992 | Schlumpf | |
| 5,178,299 | A | 1/1993 | Mundt | |
| 5,215,299 | A * | 6/1993 | Luft | 271/160 |
| 5,244,116 | A | 9/1993 | Leo | |

(Continued)

FOREIGN PATENT DOCUMENTS

JP 1-321594 12/1989

*Primary Examiner* — Mark A Deuble
(74) *Attorney, Agent, or Firm* — Pillsbury Winthrop Shaw Pittman LLP

(57) ABSTRACT

Disclosed is a biased paper dispensing device for dispensing paper. The dispensing device has a housing with an elongated body for containing paper. The housing has a lift system which may include a tray for holding the paper, a pulley system having pulleys, and elastic tubing. The tray holds the paper horizontally in the housing, and is moved vertically within the housing to dispense the paper. The lift system is used to lift or lower the paper and to bias the paper within the housing toward the lid or opening. A paper guide device for guiding paper into alignment with the opening may be provided. The opening may include at least one lateral opening portion permitting paper exposed in the opening to be withdrawn laterally therefrom. Flanges for holding the paper within the opening, and for allowing easy insertion of paper into the housing, are also provided.

31 Claims, 9 Drawing Sheets

U.S. PATENT DOCUMENTS

| | | | | |
|---|---|---|---|---|
| 5,305,996 | A | 4/1994 | Taniwa et al. | |
| 5,411,246 | A | 5/1995 | Nonomura et al. | |
| 6,250,500 | B1 | 6/2001 | Schweiberer | |
| 6,270,072 | B1 | 8/2001 | Louie | |
| 6,357,624 | B1 * | 3/2002 | Brown | 221/312 A |
| 2007/0228066 | A1 | 10/2007 | Almas et al. | |

* cited by examiner

Figure 2b
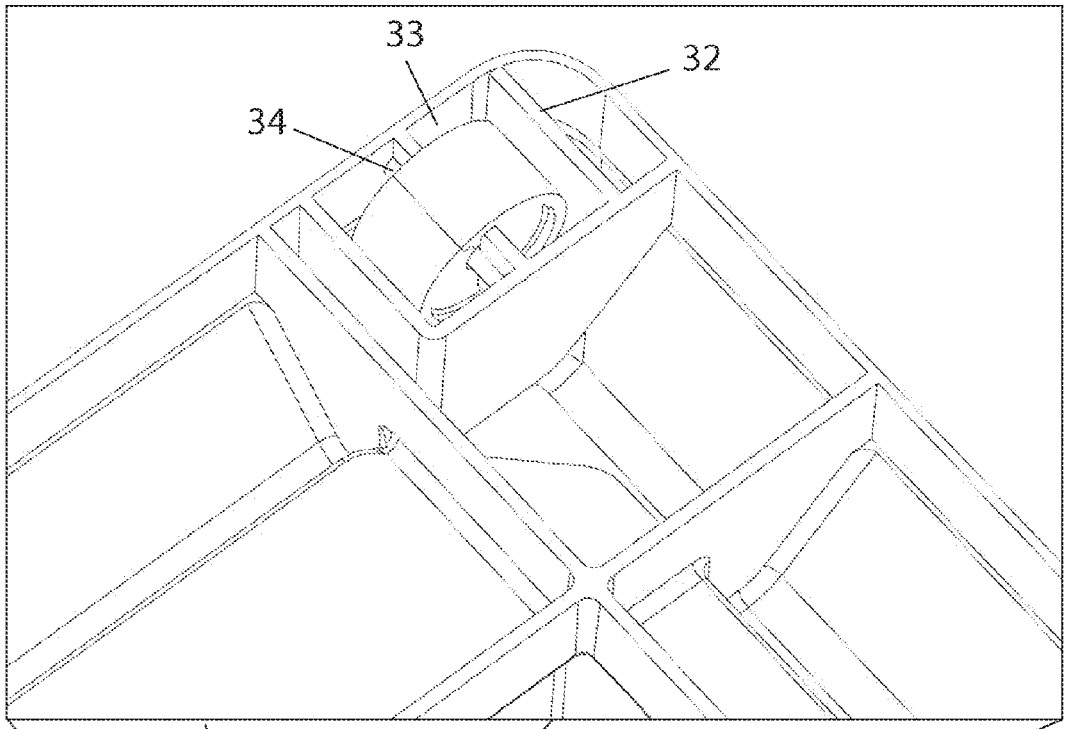
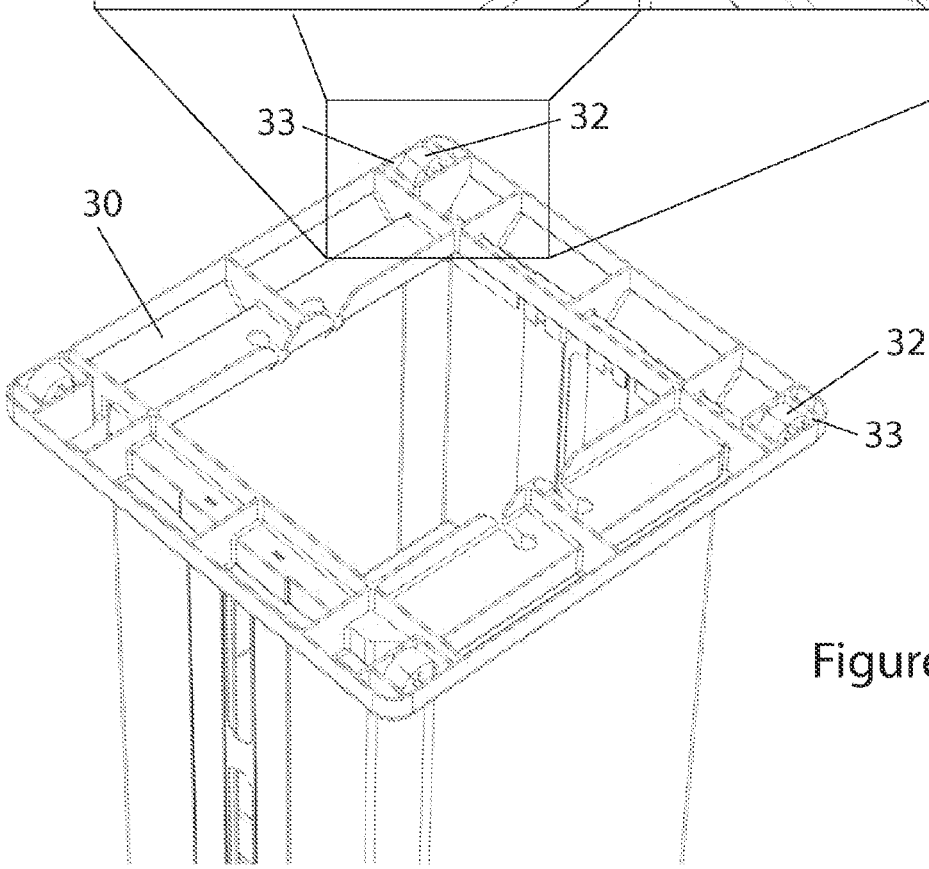
Figure 2a

BIASED PAPER DISPENSING DEVICE

CROSS REFERENCE TO RELATED APPLICATIONS

The present application claims priority to U.S. Provisional Application Ser. No. 61/059,923, filed on Jun. 9, 2008, the entirety of which is hereby incorporated into the present application by reference.

BACKGROUND

1. Field of Invention

The present invention is generally related to a method and device for dispensing paper. More specifically, the present invention is related to a paper dispensing device with a lift system.

2. Background

Generally, devices for dispensing paper in the form of paper sheets or printed articles are known. Paper is provided on a tray for lifting paper in a vertical direction towards a dispensing or feeding area, and the paper sheets may be withdrawn from the device as needed. In order to lift or move the tray to dispense paper, several prior art solutions use springs which provide a limited range of displacement. Examples of such prior art devices include U.S. Pat. Nos. 4,889,221, 5,165,571, 5,305,996, 5,411,246, 6,250,500 B1, and 6,270,072 B1 and Japanese Publication 1321594. However, if those springs are used for a larger range of displacement, the extension of the springs may be substantial enough such that the springs are stretched beyond their elastic limits, and, thus, cause the springs to lose resiliency. An improved lift system in such paper dispensing devices, therefore, would be beneficial.

Additionally, some prior art devices are not designed for easy loading and unloading of paper. A device that allows one to load and unload paper more quickly and easily is desirable.

SUMMARY

One aspect of the invention provides a biased paper dispensing device for dispensing reams of paper. The dispensing device has a housing with an elongated body for containing the paper. The housing has an upwardly facing opening for receiving the paper therein. The opening is provided in the upper part thereof and has a generally horizontal orientation. A lift system is provided in the housing including a tray and elastic tubing. The lift system is configured to move the tray vertically within the elongated body of the housing to allow access to the paper through the opening. The tray is configured to hold the paper horizontally in the housing, and is coupled to the elastic tubing. The elastic tubing extends upwardly from the tray, and is trained over a structure within the housing and extends downwardly to a connection below the structure. The elastic tubing is also configured to apply a biasing force to the tray such that the tray is biased toward the opening of the housing.

Another aspect of the invention provides a biased paper dispensing device for dispensing reams of paper, the device having a housing with an elongated body for containing the paper. The housing has an upwardly facing opening for receiving the paper therein. A lift system is provided in the housing and is configured to apply a biasing force to the paper such that the paper is biased upwardly toward and through the upwardly facing opening of the housing. The device also has flanges movable between (a) a paper retaining position extending inwardly with respect to the upwardly facing opening and in spaced relation above the upwardly facing opening to enable the flanges to contact an upper surface of paper in the housing to keep the paper in place against the bias of the lift system, and (b) a paper loading positioning extending downwardly to permit paper to be inserted downwardly between the flanges through the upwardly facing opening. The flanges are biased to the paper retaining position. Also, at least one lateral opening permits paper exposed above the upwardly facing opening to be withdrawn laterally from beneath the flanges in the paper retaining position.

Yet another aspect of the invention provides a biased paper dispensing device for dispensing paper. The dispensing device has a housing with an elongated body for containing the paper. The housing has an upwardly facing opening for receiving the paper. A lift system provided in the housing has a tray configured to hold the paper horizontally in the housing, and is further configured to apply a biasing force to the paper such that the paper is biased toward and through the upwardly facing opening of the housing, and configured to move the paper vertically within the elongated body of the housing to allow access to the paper through the upwardly facing opening. A paper guide device is positioned below the upwardly facing opening. The paper guide device is configured to engage paper on the tray and guide the paper into alignment with the upwardly facing opening.

Other objects, features, and advantages of the present invention will become apparent from the following detailed description and the accompanying drawings.

BRIEF DESCRIPTION OF THE DRAWINGS

FIGS. 2*a* and 2*b* illustrate bottom and detail views of wheels on a bottom of the biased paper dispensing device of FIG. 1 in accordance with an embodiment of the present invention;

DETAILED DESCRIPTION OF THE PREFERRED EMBODIMENT(S)

The paper dispensing device as herein described is such that the lift tray has a larger range of displacement and, thus, assists in providing a more stable operating lift device. The paper dispensing device is designed such that the paper housed therein is generally biased in an upward direction toward an upwardly facing opening to allow one to access or withdraw paper as needed. A paper guide device for guiding paper into alignment with the opening is also disclosed. Additionally, the opening may include at least one lateral opening portion permitting paper exposed in the opening to be withdrawn laterally therefrom, thereby easing unloading of paper. Flanges for holding the paper may also be provided within the opening, which allow for easy insertion or loading of paper into the housing. The system used to bias the paper in the device is also less expensive, and provides additional benefits as noted throughout the description below.

Figure 1:
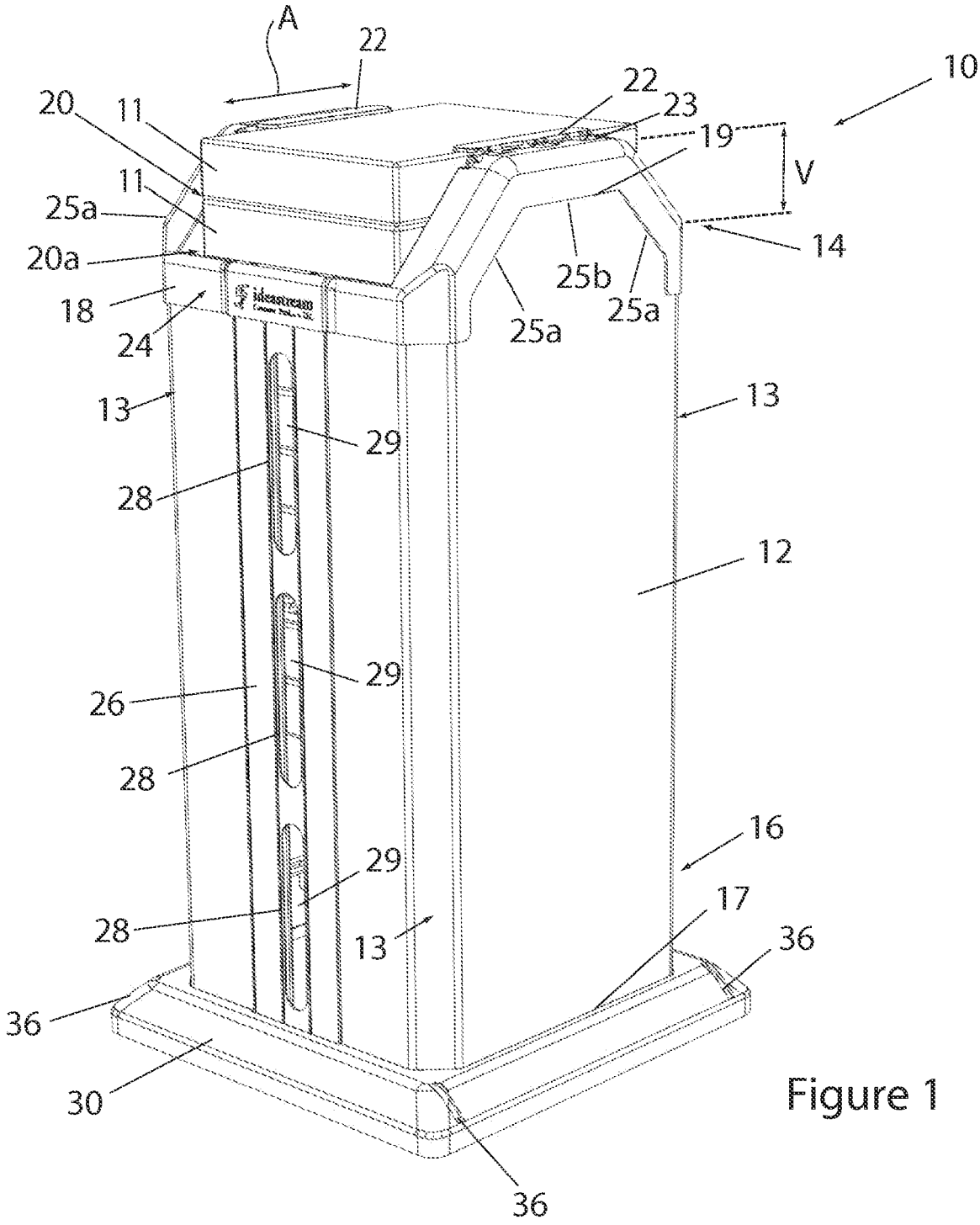
FIG. 1 illustrates a perspective view of a biased paper dispensing device in accordance with an embodiment of the present invention.

Referring now more particularly to the drawings, FIG. 1 illustrates a perspective view of a biased paper dispensing device 10. Biased paper dispensing device 10 comprises a housing 12 with an elongated, upright body. Generally, the elongated body of housing 12 is designed to store a plurality of material(s) such as paper in individual bound stacks or reams 11. Conventionally, a ream is defined as a stack of 500 sheets of standard boxed or offset paper. However, stacks of a greater or lesser size may be used. For example, a stack of 1000 sheets may also be used in accordance with an embodiment of the present invention.

Each stack or ream 11 may be held together by any type of binder, such as an encircling band or a fully encasing wrapper. The housing 12 may comprise four sides which meet at corners 13 to form a substantially square or rectangular shape. However, the shape and size of housing 12 should not be limited. For example, the housing 12 may be designed such that it holds paper of a standard size (e.g., 8½×11, A4, legal, etc.) or any number of sizes and shapes. In an embodiment, the corners 13 of the housing 12 may be rounded or flattened.

The elongated body of housing 12 comprises an upper part 14 and a bottom or lower part 16. The upper part 14 of the housing 12 comprises a lid 18. Lid 18 may be removable from the upper part 14 of the housing 12. Lid 18 may be securely fastened to an upper edge 19 on the upper part 14 of housing 12. Lid 18 may be contoured to fit a perimeter of the upper edge 19 so as to provide a flush and tight fit. Lid 18 also comprises an opening 20 for access to the material or paper that is biased upwardly by a lift system 38 within the housing 12 (further described below). Methods of attaching lids are generally known and therefore will not be described in detail. The opening 20 is an upwardly facing opening for receiving paper therein, and is generally provided in the upper part of the housing 12.

FIG. 1 shows lid 18 and upper edge 19 with generally horizontal or straight side sections 24. Straight sections 24 are provided on opposite sides of the lid 18, upper edge 19 of housing 12, and opening 20, for example. Sloped or angled side sections 25*a* may extend at an upward angle from each end of the straight side sections 24. Sloped sections 25*a* of lid 18 are connected via a straight top section 25*b* to enclose the upwardly facing opening 20. The sections 24, 25*a*, and 25*b* allow for sheets or reams 11 of paper to be accessed from the opening 20. In an embodiment, a user may access and withdraw an entire ream of paper from the opening 20 in the lid 18. Additionally or alternatively, the opening 20 may be configured to allow for access to add one or more reams of paper into the housing 12.

The opening 20 may have a generally horizontal orientation. The opening 20 allows access to paper in the housing 12, such as by pulling or sliding paper from the housing 12. More specifically, in an embodiment, the configuration of the sloped and straight sections (24, 25*a*, and 25*b*) may provide the capability of pulling paper from the device 10 in a horizontal or lateral direction (i.e., in a direction that is perpendicular to movement of the stack(s) in the housing 12). That is, for example, the device 10 may comprise at least one lateral opening portion 20*a*. The at least one lateral opening portion 20*a* permits paper exposed via upwardly facing opening 20 to be withdrawn laterally therefrom.

Figure 3A:
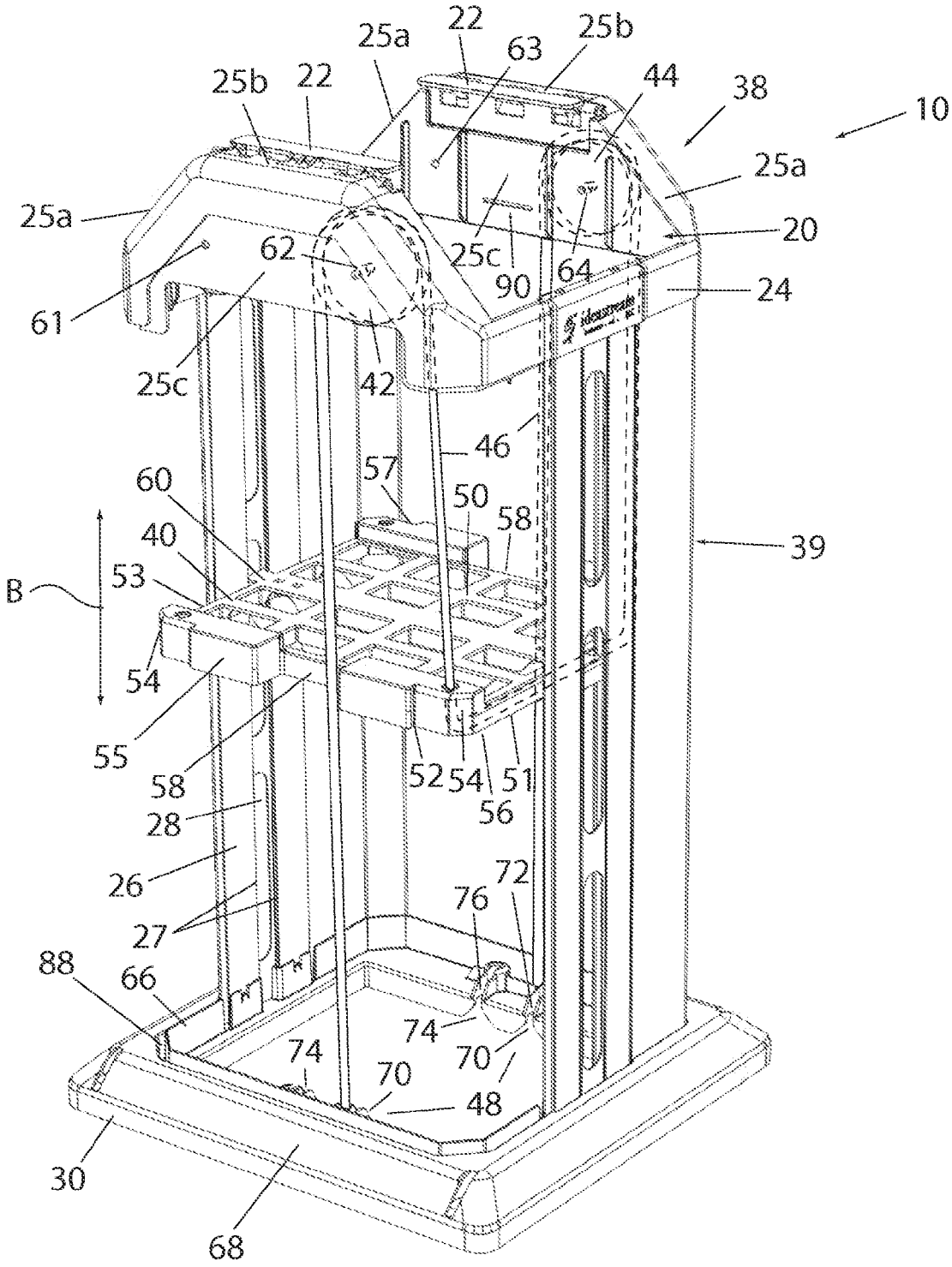
FIG. 3*a* shows an internal view of parts of a lift system within the biased paper dispensing device of FIG. 1 in accordance with an embodiment of the present invention.

As shown in greater detail in FIGS. 1 and 3*a*, for example, the lid may have a top portion and a front portion. The top portion may have a generally horizontal configuration, and the front portion may extend downwardly from the top portion on at least one side, so as to form a lateral opening 20*a* to expose an amount of paper (e.g., one or more reams) for dispensing therefrom. As shown in FIG. 1, the sloped sections 25*a* and straight section 24 on a side of the device 10 help form the at least one lateral opening portion 20*a*. A similar lateral portion may be formed on the opposite side of the device (shown partially in FIG. 3*a*, for example). With this configuration, at least an uppermost portion or amount of paper may be dispensed or slid out from the at least one lateral opening portion 20*a* in a generally horizontal or lateral direction, as indicated by arrow A in FIG. 1 (arrow A indicates that the paper may be dispensed laterally through a lateral opening 20*a* on either side of the device 10). Thus, a vertical extent V of the opening 20*a* may be configured such that it exposes an amount of paper and at least allows access to an uppermost portion of a stack of paper within housing 12. In some embodiments, the sections 24-25*b* of the lid may be designed such that the vertical extent V of the opening 20*a* is at least a height of a thickness of at least one ream of paper 11 (as defined above). In some embodiments, the vertical extent V of the lateral opening 20*a* may be configured to be greater than the thickness of one ream of paper. Additionally, the shape of the lid 18, upper edge 19, and openings 20, 20*a* are designed such that they not only assist a user accessing reams of paper, but also to provide a housing or compartment for at least a part of the lift system 38, as further described below in FIG. 3*a*.

Figure 4A:
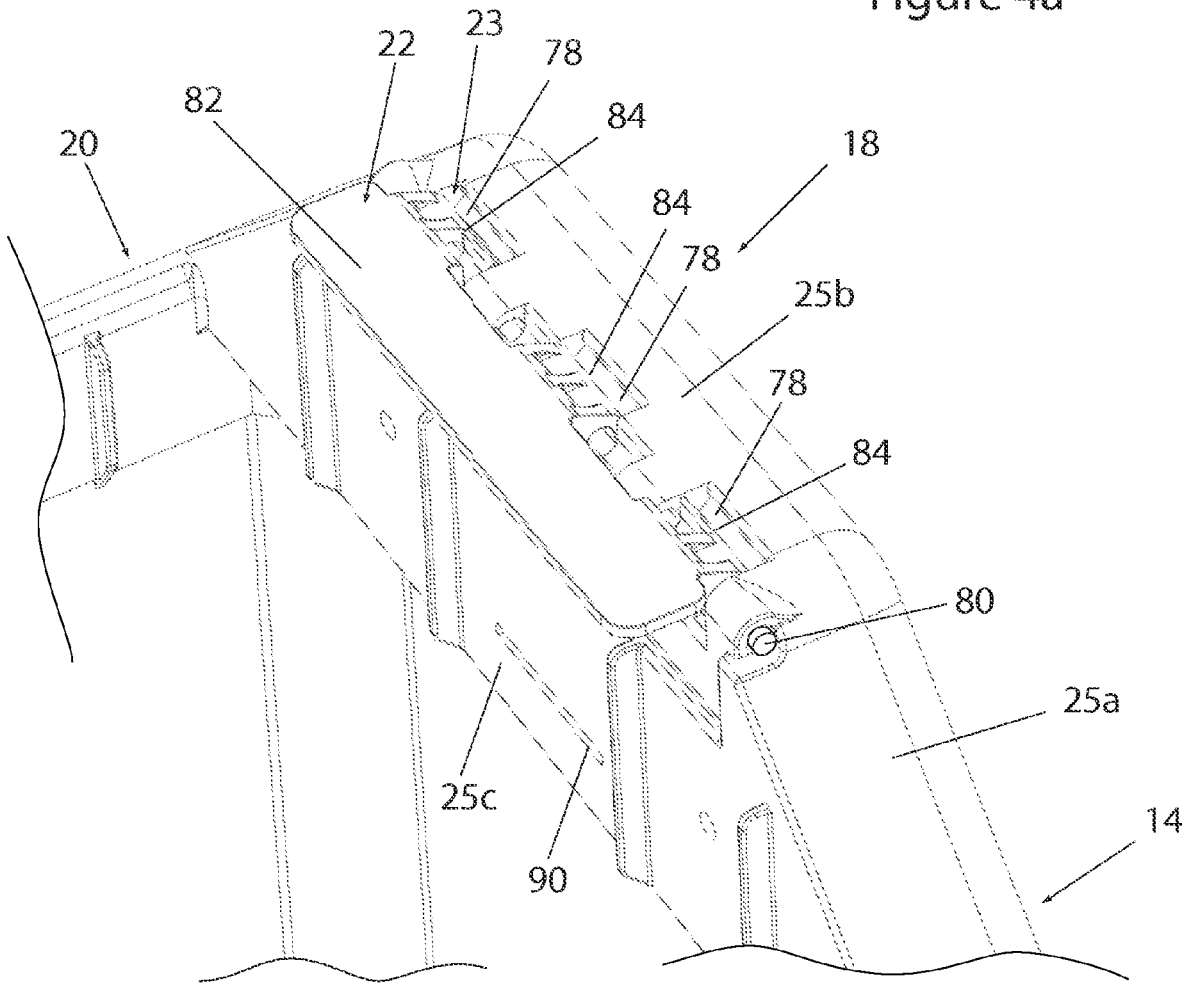
FIG. 4*a* illustrates a detailed view of flanges used with a top of the biased paper dispensing device of FIG. 1 in accordance with an embodiment of the present invention.
Figure 4B:
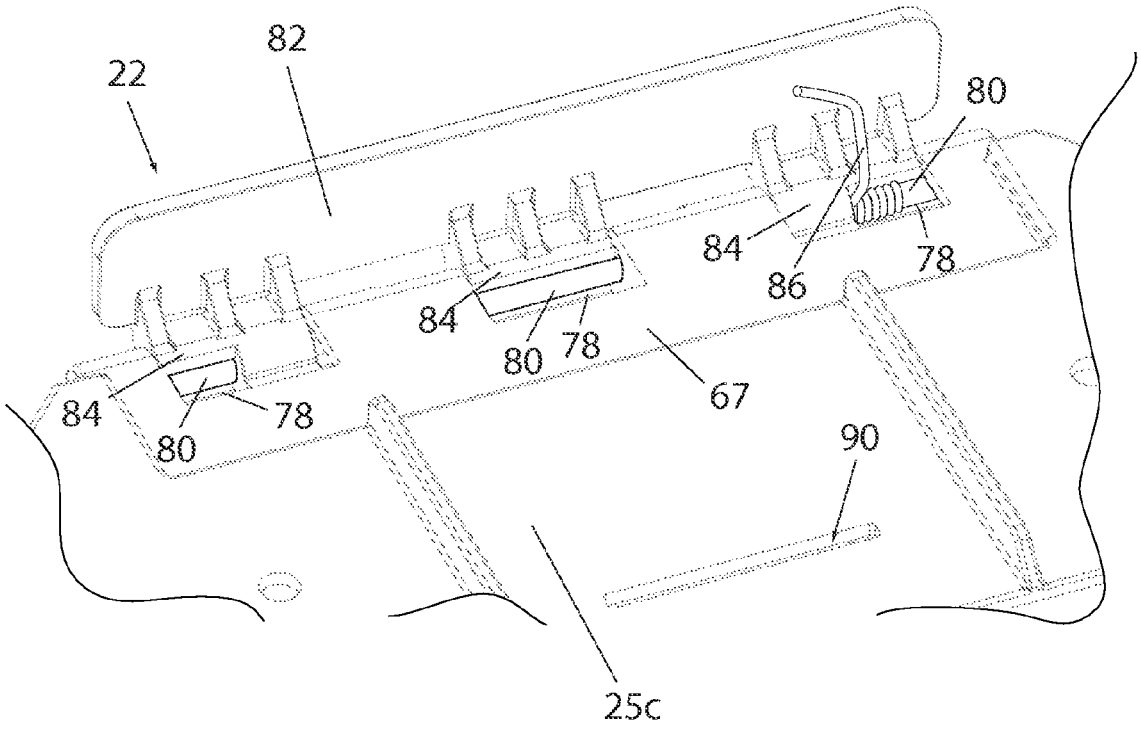
FIG. 4*b* illustrates an underside view of the flanges of FIG. 4*a;*
Figure 4C:
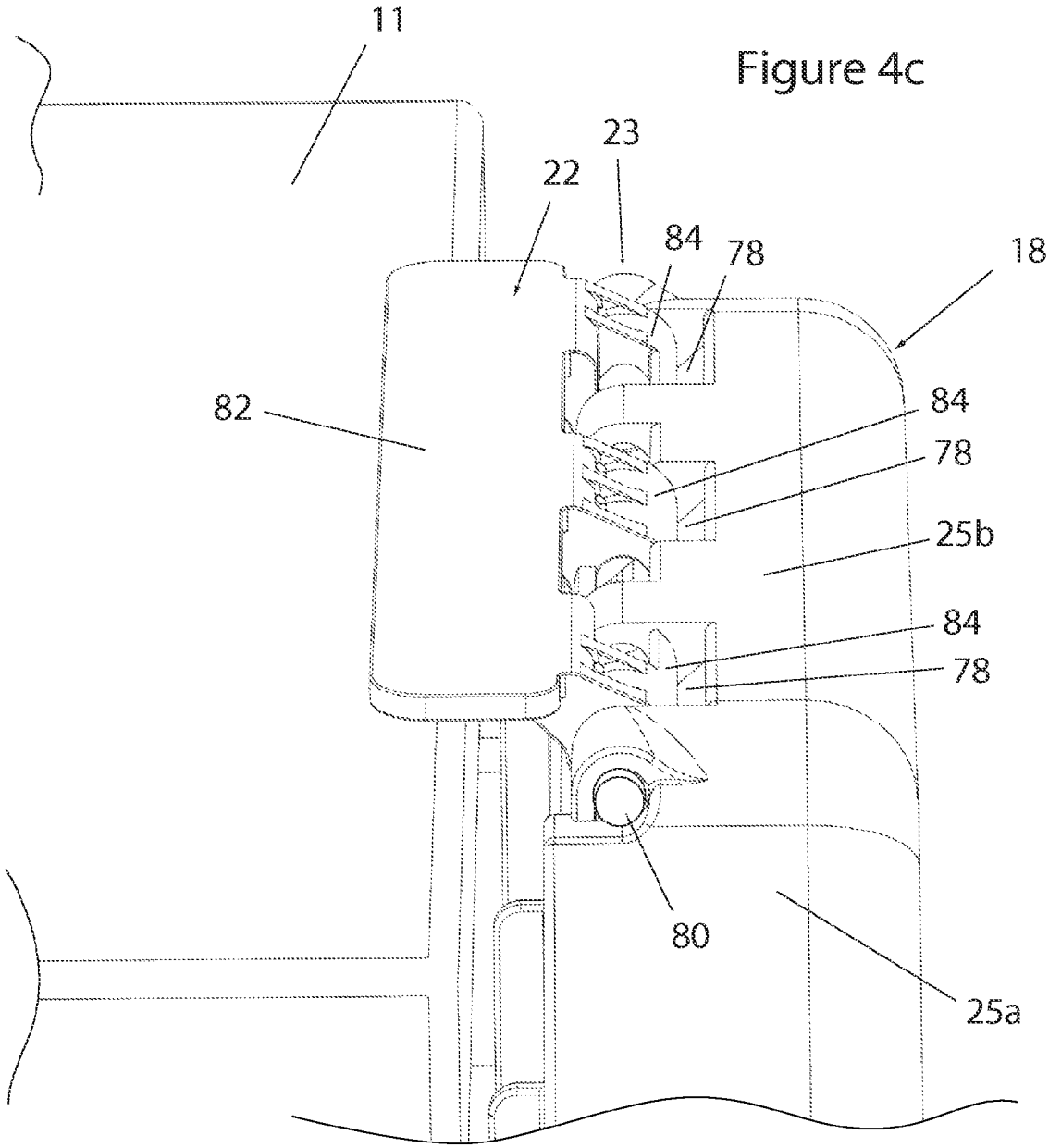
FIG. 4*c* illustrates a perspective view of the flanges of FIG. 4*a* attached to a lid of the biased paper dispensing device in accordance with an embodiment of the present invention.

As shown in FIG. 1 and in detail in FIG. 4, the straight top sections 25*b* of the lid 18 are designed such that they can accommodate and provide attachment for one or more flanges 22. Flanges 22 may be provided to keep paper in place against the bias of the lift system 38 within the elongated body of housing 12. The flanges 22 may be connected by hinges 23 such that they pivot with respect to the lid 18 and opening 20. Additional description with respect to the flanges 22 is further provided below in FIGS. 4*a*-4*c*.

Referring back to FIG. 1, the elongated body of housing 12 may comprise a viewing section 26 along at least one of the sides of the housing 12. Viewing section 26 may extend approximately the entire height of a side of the housing 12. Viewing section 26 may include elongated slots or openings 28 so as to provide a window of visibility to the material or paper within the housing 12. For example, the location of the paper in relation to the height of the housing 12 may indicate the amount of paper provided within the housing 12. Openings 28 may have a substantially transparent material 29 therein, or, alternatively may be generally open slots. The location and orientation of viewing section 26 and/or elongated slots 28 should not be limited to those shown. For example, in some embodiments, viewing section 26 may be provided on two or more sides of the housing 12. Additionally, although three openings 28 are shown positioned along the housing 12, viewing section 26 may comprise one uniform opening or any number of openings or windows that show or allow for viewing the amount of paper within the elongated body of the housing 12. In an embodiment, openings 28 or viewing section 26 need not be provided.

The lower part 16 of the housing 12 comprises a base 30. Base 30 may be provided to assist in providing stability on a surface, for example. A bottom edge. 17 on the lower part 16 of the housing 12 may be attached to base 30. In an embodiment, base 30 may be formed with a channel 88 that is designed to receive at least a portion of the bottom edge 17 of housing 12, for example. A channel 88 may be provided between an inner wall 66 and outer wall 68 (better shown in FIG. 3*a*), for example. However, channel 88 is not required for connecting housing 12 to base 30. Bottom edge 17 or lower part 16 of housing 12 and base 30 may be securely fastened to each other using known methods in the art, such as a snap-fit construction or using fasteners or bolts.

In an embodiment, base 30 may also include a device for allowing movement with respect to a surface. FIGS. 2*a* and 2*b* illustrate a bottom and detailed views, respectively, of wheels 32 on a base 30 of the biased paper dispensing device 10 in accordance with an embodiment. The base 30 may be designed or formed such that it holds wheels 32 therein Preferably at least one wheel 32 is provided with the dispensing device 10. FIG. 2A shows that four wheels 32 may be provided near the corners or edges of the base 30, for example.

As shown in detail in FIG. 2*b*, each wheel 32 is provided within an opening 33 in base 30. Openings 33 may be provided in the bottom of the outer wall 68 of the base 30, for example. Wheel 32 is provided on an axle 34 which is designed to fit into opening 33. Opening 33 assists in at least partially hiding the wheel 32 such that when biased paper dispensing device 10 is upright, dispensing device 10 provides little visible showing of the wheels. In an embodiment, wheels 32 may be designed such that they lift the dispenser approximately 0.25 inches (0.6 centimeters) off the ground or floor surface for which it is positioned thereon. In an embodiment, wheels 32 are provided on molded axles. The slots 36 of base 30, as seen in FIG. 1, therefore, may be provided to assist in or as a result of the process of molding features for the axle to mount wheels 32 into the base 30. However, such slots 36 need not be provided.

Wheels 32 may provide at least a forward and backward movement on a surface. However, in an embodiment, the wheels 32 may be designed such that they incorporate 360 degree movement in any direction. For example, swivel, ball, rollers, or other known devices may be provided on the base 30. In an embodiment, the wheels 32 may comprise materials such that they are assembled together such as a two-part snap together wheel.

FIG. 3*a* illustrates an internal view of parts of a lift system 38 within the biased paper dispensing device 10 of FIG. 1 in accordance with an embodiment. FIG. 3*a* shows elements of a first part 39 of the lift system 38 on a first side. However, it should be noted that lift system 38 incorporates the same elements (not shown) on a second side to assist in lifting paper reams or stacks 11. Specifically, the elements of the lift system 38 on the other side will be essentially a mirror image of first part 39, and will apply essentially the same upward force as first part 39 through the range of movement. The lift system 38 moves in a generally vertical direction (i.e., up and/or down) as indicated by arrow B, such that the paper reams or stacks 11 may be displaced upwardly under bias when paper is removed or displaced downwardly against the bias as paper is added to the housing 12.

The lift system 38 is designed such that it comprises at least a lift tray 40 and elastic tubing 46. The lift system 38 is provided within the housing 12 and is configured to move the lift tray 40 vertically within the elongated body of the housing 12 to allow access to the paper through the openings 20, 20*a*. A structure is used with the elastic tubing in the housing 12. In all embodiment, the structure may comprise a plurality of pulleys, such as a first pulley 42 and a second pulley 44. In the illustrated example embodiment, the pulleys 42, 44 and tubing 46 constitute the first part 39 of the lift system 38, mentioned above, and the same parts will also be on the other side as mentioned above to constitute the second part.

Lift tray 40 is configured to hold the paper horizontally in the housing 12 and is coupled to the elastic tubing 46. Lift tray 40 comprises four sides 51, 53, 55, and 57 and a base 50 which includes edges 52, corners 54, and at least one channel 56 that runs along edges 52 of the tray 40. The lift tray 40 may be generally square in shape as shown in FIG. 3*a*. In an embodiment, at least the base 50 of tray 40 may be designed such that it comprises a similar or substantially similar shape to that of the interior of the housing's 12 elongated body. In an embodiment the edges 52 and corners 54 on the sides 51-57 of the tray 40 are contoured such that they also comprise a similar shape with respect to the housing 12. For example, the corners 13 of housing 12 are generally angled or flattened with respect to the sides of the housing 12. Similarly, the corners 54 of tray 50 may also comprise an angled or flattened shape with respect to the sides 51, 53, 55, and 57 of the tray.

The edges 52 of the tray, as noted above, may be designed in an embodiment such that they have at least one channel 56 on a first side 51 and a second side 53 of the tray 40. The channel(s) 56 may be provided in a separate configuration on each side or as a single channel along the perimeter or edge(s) of the tray 40. The channel(s) 56 in the edge 52 of the tray 40 are designed to receive at least a part of the elastic tubing 46 of the lift system 38 therein. In an embodiment, the channel(s) 56 run on the underside of the tray 40 along edges 52. Also, at least one opening 62 is provided in the tray 40 to allow the tubing 46 to pass therethrough. In an embodiment, two openings 62 may be provided in or near the ends of the channel(s) 56. In an embodiment, openings 62 are provided within the ends of the channel(s) 56, so that the tubing 46 may be inserted or directed downwardly through the openings 62 and inserted into the channel(s) 56 running along the sides 51, 53.

Cutouts 58 are provided on opposing sides 55, 57 of the tray 40 such that when the lift system 38 is assembled, elastic tubing 46 may run or pass through sides 55 and 57.

The elastic tubing 46 extends generally upwardly from the tray 40, and is trained over a structure within the housing 12 and extends downwardly to a connection below the structure. As noted above and further described below, in an embodiment, the structure comprises a plurality of pulleys 42, 44 configured to receive at least part of the elastic tubing 46 around their perimeters to assist in moving the tray vertically. The elastic tubing 46 is configured to apply a biasing force to the tray 40 such that the tray 40 is biased toward the opening 20 and/or 20*a* of the housing 12.

Also shown in FIG. 3*a* on first side and second sides 51, 53 of tray 40 are extension guides 60 or inserts extending from the tray that may be used to assist in guiding tray 40 during lifting and/or lowering operations. Extension guides 60 may be guided vertically in the device 10 with respect to viewing section 26, for example. That is, in an embodiment, viewing section 26 may include guide slots 27 on opposite sides therein that are designed to receive at least a part of the extension guides 60 of the lift tray 40. In an embodiment, the guide slots 27 may designed such that they are provided on or substantially near or adjacent the inner wall of the viewing section 26 as shown, or, in the alternative, along another part of the inner wall of the housing 12 such as along or substantially near the corners 13, for example. The guide slots 27 may be provided on one or more inner sides of the housing 12 and their location should not be limiting. In an embodiment, the guide slots 27 may be substantially the same length as the viewing section 26, for example, such that the tray 40 may move the vertical extent of the housing 12.

Figure 6:
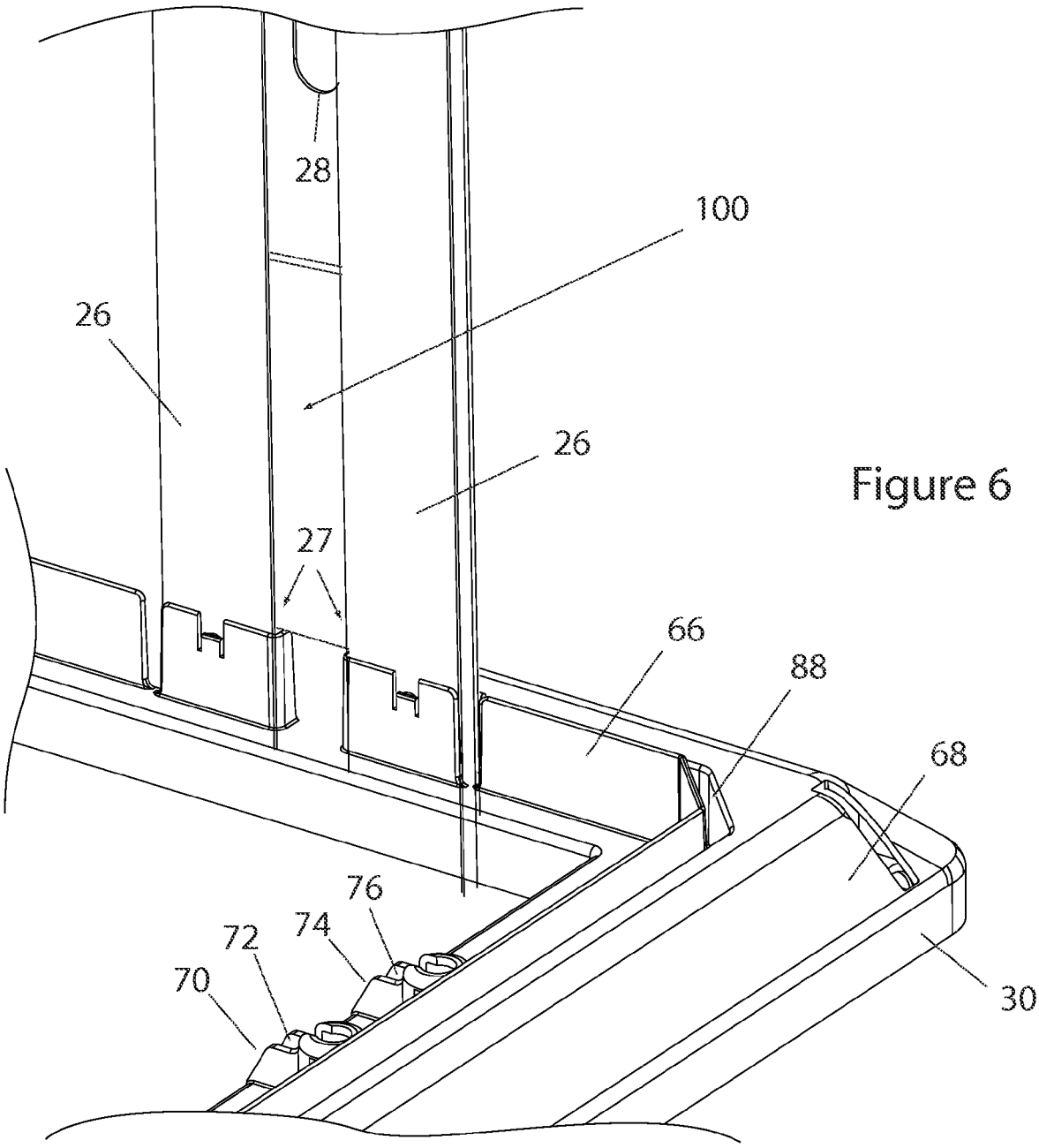
FIG. 6 illustrates a perspective view of a limitation device to be used with the biased paper dispensing device in accordance with an embodiment of the present invention.

In an embodiment, the viewing section 26 and/or guide slots 27 may be provided with a limitation device 100, as shown in detail in FIG. 6. Limitation device 100 may limit the displacement of guiding tray 40 within the guide slots 27. For example, limitation device 100 prevents a user from lowering a guide tray 40 to a position lower than the top of the limitation device 100. One benefit of the limitation device 100 is that it prevents a user from overloading the biased paper dispensing device 10 with paper reams 11, and, thus, prevents overextension of elastic tubing 46 (e.g., stretching beyond its elastic limits).

In an embodiment, the limitation device 100 may be designed or configured such that it determines the maximum number of paper 11 (or reams) that may be placed within the device 10. For example, assuming a standard ream of paper 11 comprises approximately 500 sheets and has a paper weight (also referred to as basis weight or ream weight) of approximately five (5) pounds (lbs), the limitation device 100 may be designed to comprise a height that limits the biased paper dispensing device 10 to accepting no more than approximately ten (10) reams of paper 11 (i.e., a total paper weight of all reams being approximately 50-60 pounds), so that the tubing 46 is not overextended.

In another embodiment, limitation device 100 may comprise any number of sizes or shapes. For example, the limitation device 100 as shown in FIG. 6 may be a structure designed to fit within the guide slots 27. Also, the location of limitation device 100 within the viewing section 26 or guide slots 27 should not be limiting. For example, FIG. 1 illustrates 3 elongated slots 28 provided in viewing section 26. A bottom elongated slot 28 may be removed and/or concealed by limitation device 100 (as shown in FIG. 6). Alternatively, the limitation device 100 may be provided in an intermediate section along the viewing section 26 or guide slots 27. The limitation device 100 may also be attached to the base 30 of the device in an embodiment. Generally, the size, shape, configuration, or design of the limitation device 100 should not be limiting, and the limitation device 100 may be designed and/or provided in a location anywhere within, around, or along the housing 12 that is sufficient enough to limit the displacement or lowering of the guiding tray 40 with respect to the elongated body of the housing 12.

Referring back to FIG. 3*a*, as noted above, first and second pulleys 42, 44 may also be included on the first side 39 of the lift system 38 as shown (and are likewise replicated on the other side of the system 38, which is not shown). First and second pulleys 42, 44 are structures that may be designed such that they cooperate with the tubing 46 provided in first side 51 of the tray 40, for example. First pulley 42 is provided on first axle 62 and second pulley 44 is provided on the second axle 64. Also, openings provided for the axles of the other set of pulleys can be seen at 61 and 63, on the other side of the system 38, in FIG. 3*a*. First axle 62 and second axle 64 are designed such that they horizontally align pulleys 42 and 44. First and second pulleys 42, 44 are mounted on axles 62, 64 and receive at least a part of the elastic tubing 46 around their perimeters. The first and second pulleys 42, 44 assist in allowing movement of tubing 46 as the tray 40 is lifted or lowered, for example. However, it should be noted that the use of the first and second sets of pulleys in the lift system 38 is optional. Additionally, the use of elongated elastic tubing 46 is also optional, further described below.

Figure 5:
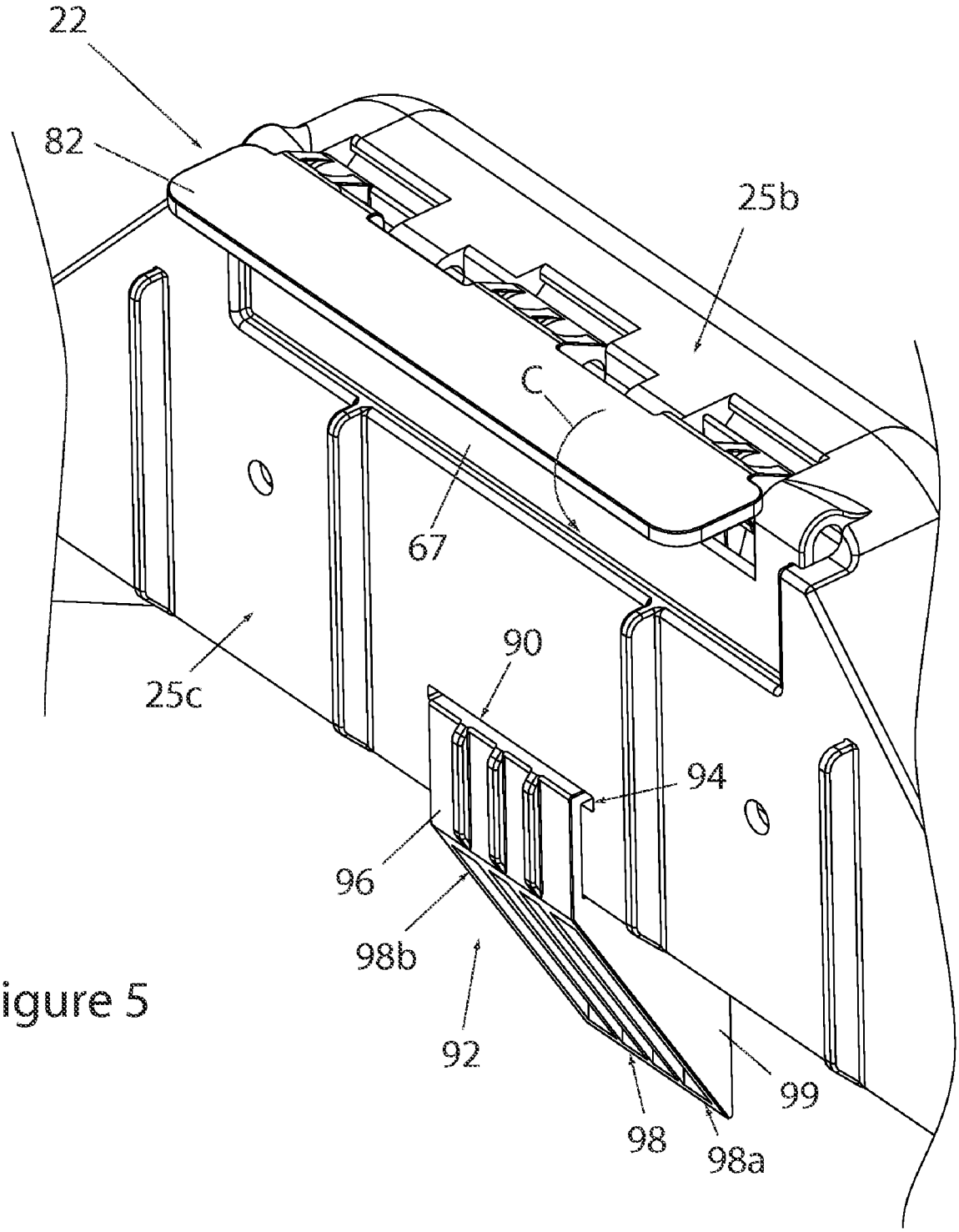
FIG. 5 illustrates a perspective view of a paper guide device to be used with the biased paper dispensing device in accordance with an embodiment of the present invention.

As previously noted, lid 18 may further comprise extension walls 25*c* on opposing sides. Extension walls 25*c* extend generally downwardly from the sloped and straight top sections 25*a* and 25*b* on either side of the lid 18. Extension walls 25*c* are designed to be received or insert into openings (not shown) provided in the upper edge 19 of the housing 12. As previously noted, extension walls 25*c* may also be designed to assist in housing and hiding at least a part of the lift system 38. First and second pulleys 42 and 44, for example, may be mounted or housed within the extension wall 25C such that they are hidden from plain sight with the housing 12. Extension walls 25*c* may also provide additional support for mounting the pulleys 42, 44 on the axles 62, 64. In an embodiment, extension walls 25*c* may include an attachment section 90 for at least a part of a paper guide device 92 (as shown in FIG. 5) which may assist in directing or guiding paper within the elongated body of housing 12. Additional description of guide device 92 is further provided below.

FIG. 3*a* also illustrates further details of the inner wall 66 and the outer wall 68 of the base 30. At least one mounting area 48 may be provided on the inner walls 66 of the base 30. In an embodiment, a mounting area 48 is provided on opposing sides of the base 30. For example, a mounting area 48 may be provided on the sides of the base 30 that are parallel with the cutouts 58 of opposing sides 55, 57 of the lift tray 40. In an embodiment, the mounting area 48 is vertically aligned with the cutouts 58 in the tray 40.

Figure 3B:
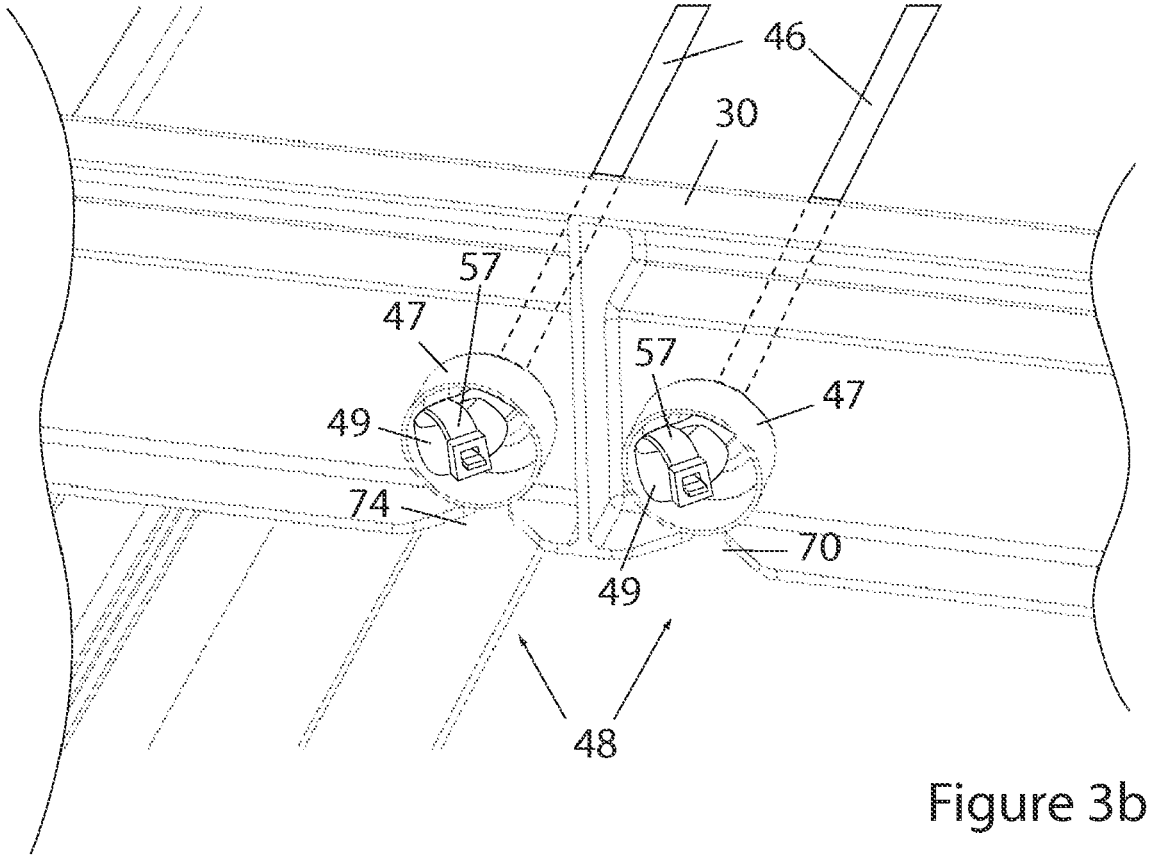
FIG. 3*b* illustrates a detailed view of a connection for elastic tubing used with the lift system of FIG. 3*a;*

The mounting area 48 may comprise a first set of openings 70 and a corresponding set of slots 72 that cooperate or are connected to the first set of openings 70. The openings 70 and slots 72 are designed such that they may receive an end or part of the tubing 46 therein. That is, after an end of the tubing 46 is insert into opening 70 and fit within slot 72, the slot 72 is used to assist in hooking or locking end of tubing 46 to the base 30. In an embodiment, the elastic tubing 46 is hooked, fastened, locked or secured underneath the base 30. FIG. 3*b* illustrates a detailed view of a connection of the tubing 46 through the mounting area 48 of the base 30. Specifically, a bottom or underside view of the base 30 is shown. Devices such as a fastener, a knot in the tubing, a hook, washers, or other device(s) may be use to hold an end of the tubing 46. As shown in FIG. 3*b*, for example, a stopper 47 may be provided on the underside of the opening 70 and/or slot 72 and the tubing 46 may be crimped 49 and tied with a cable tie 57 to secure the tubing 46 in the base 30 at a correct length to provide appropriate tension for the lift system 38. The stopper 47 may be designed to encase or contain the crimp 49 and/or the cable tie 57 at the end of the tubing 46. Generally, however, any known methods or devices for securing the end of the tubing 46 may be used. For example, the tubing may be knotted without the use of a tie 57 or stopper 47.

Also shown in FIG. 3*a* is a second set of openings 74 and second pair of slots 76 designed to cooperate with a second half (not shown) of the lift system 38 (e.g., a second piece of tubing 46 extending from a second side 53 of the tray 40 and over a second set of pulleys (on axles 61 and 63). The tubing 46 is placed and secured in the mounting area 48 and/or underneath the base 30 in a similar manner as described above, i.e., by inserting an end of the tubing 46 into opening 74 and within slot 76, and crimping 49 the end to be tied with a tie 57 and held in stopper 47.

Generally the lift system 38 is assembled and manipulated as follows: After securing the elastic tubing 46 within or under the base 30, the tubing 46 is directly upwardly through a cutout 58 of the tray and around one of the pulleys 42, 44. The tubing 46 is then directed through an opening 62 in the tray 40 and along the channel 56 underneath it. The tubing 46 may then be pulled and directed upwardly through an opposite opening near the opposing side of the tray 40, such that the tubing 46 is run substantially along an underside of side 51, for example. The tubing 46 is then directed upward and around the other of the pulleys 42, 44 and downwardly toward the base 30 where it will be secured within or under. The same is repeated on the other side with essentially the same components. After both sides of the tray 40 are supported by the tubing, pulleys, and base of the lift system 38, the lift tray 40 may receive reams or stacks 11 of paper. As the reams 11 of paper are insert on the tray 40 in the housing 12, the lift tray 40 is guided (e.g., using lift system 38 and guides 60) in a vertical direction downwardly by manual force on the tray 40 or reams 11 (if present). The pulleys 42, 44 may rotate on the axles 62, 64 and the tubing 46 may move, resiliently stretch, and/or vary as needed to accommodate for the reams 11 of paper placed on the tray 40. As paper is lifted from tray 40, the lift tray 40 is guided in a vertically upward direction due to the bias of the tubing 46.

One non-limiting advantage of using the elongated elastic tubing 46 (or any other relatively long and resilient member) together with the routing path illustrated is that the ratio of displacement versus overall length can be decreased over the tray's range of motion. This in turn means that the range of bias force applied to the tray will not vary as significantly as would be the case if the routing were shorter (e.g., such as with the tubing merely suspended from the top part and connected at its bottom to the tray).

FIGS. 4*a* and 4*c* illustrate a detailed and a perspective view, respectively, of flanges 22 used with the lid 18 of the bias paper dispensing device 10 to keep paper in place against the bias of the lift system 38. FIG. 4*b* illustrates an underside view of the flanges 22 of FIG. 4*a*. The flanges 22 may comprise a flap 82 or other device and are configured to be in contact with an upper surface the reams 11 of paper in the housing 12 to keep the paper in place against the bias of the lift system 38. The flanges 22 or flaps 82 may take the form of any size, shape, or dimension. The flanges 22 may be hingedly attached to the straight edge 25*b* of the lid 18. More specifically, the straight edge 25*b* of the lid 18 may comprise a receiving portion 78. The flange 22 may comprise corresponding edge 84 that is designed to extend from the flap 82 and into receiving portions 78. The hinge 23 may be formed by connecting the receiving portion 78 and edge 84 with an axle 80. The axle 80 as shown is rotatable about a horizontal axis. Axle 80 may be mounted through openings in the receiving portion 78 of the lid 18 and openings in the edge 84 of the flange 22. Axles 80 may be secured with respect to ends of the receiving portion 78, for example. The flaps 82 or flanges 22 may lie horizontally along the horizontal axis and in direct contact with the uppermost paper or ream 11.

In an embodiment, one or more torsion springs 86 may be provided on axle 80 as shown in FIG. 4*b*. The spring(s) 86 may be provided to keep the flanges 22 biased to a paper retaining position. That is, the flanges may be biased in a position extending inwardly with respect to the upwardly facing opening 20 (and also with respect to the straight sections 25*b* of the lid 18) and in spaced relation above the opening 20. Thus, the spring 86 may assist in forcing the flaps 82 upwardly so that the flanges 22 contact or engage an upper surface of paper in the stack 11 or uppermost ream 11 to keep the paper in place against the bias of the lift system 38. In an embodiment, two or more springs may be provided about the axle 80. As paper is removed from the housing 12 via opening 20/20*a*, the paper and tray 40 is biased or moved vertically upwardly against the flanges 22 or flaps 82, so that the next uppermost portion of the stack or ream of paper 11 is positioned for dispensing.

In an embodiment, reams 11 of paper may be added by moving flanges 22 from the paper retaining position to a paper loading position. For example, paper may be added by pushing flanges 22 downwardly into the top portion of the opening 20 of lid 18. The flanges 22 or flaps 82 may be moved to a position extending downwardly to permit paper to be inserted downwardly between the flanges 22 and through the upwardly facing opening 20. More specifically, a user may stack an amount of paper adjacent the top portion of the lid 18 and opening 20 and on flanges 22/flaps 82. Then, a user may provide enough force to the flaps 82 of the flanges 22 so as to rotate the flanges 22 using axle 80 about the horizontal axis (and thus the flaps 82) downwardly in a direction as indicated by arrow C toward an inner wall of the lid 18 against the bias of spring 86 (see FIG. 5). For example, the flaps 82 may be rotated about their horizontal axis toward a depression 67 in an inner wall of the lid 18 (as shown in detail in FIGS. 4*b* and 5). The depression 67 under flange 22 enables it to be flush with the inside extension wall 25*c* when the flange 22 is rotated about axle 80 to a vertical position. Thus, the paper may be added downwardly into the housing 12 and onto the tray 40 for dispensing. One non-limiting advantage of this construction is that a new stack or ream 11 of paper may be seated atop the flanges 22 or flaps 82 and then pushed downwardly so as to pivot the flanges 22 or flaps 82 out of the way, thereby providing an easy method for loading the paper onto the tray 40 and into housing 12. Also, no disassembly or reassembly of one or more of the parts of the device 10 is required for reloading the device with paper (or for dispensing paper therefrom). The resiliency of the tubing 46 of the lift system 38, for example, farther allows for ease in loading paper via movement of the tray 40 in a downward direction. Once the paper is pushed down beyond the flanges 22, the flanges 22 will return to their normal horizontal and biased inwardly extending positions for retaining the paper (i.e., by rotating about the horizontal axis of axle 80 in a direction opposite of arrow C).

Additionally or alternatively, it is also envisioned that in an embodiment the flanges 22 may be rotated about axle 80 away from opening 20, i.e., in a direction opposite of arrow C, such that they extend vertically or diagonally in a position toward straight edge 25*b* of the lid 15, also allowing for the insertion of reams of paper. Furthermore, it is noted that the flanges 22 may be configured to be pushed or pulled (or both) in one or more/either direction for the removal or retrieval or paper/reams 11 from the housing 12.

Further, it should be noted that, as shown in FIG. 1, the at least one lateral opening 20*a* permits paper exposed above the upwardly facing opening 20 to be withdrawn laterally from beneath the flanges 22 in the paper retaining position.

The pulleys 42 and 44 as described may be any type of pulley. For example, the pulleys may be drive pulleys, round belt pulleys, or any other type of pulley, and should not be limiting. Generally the pulleys 42 and 44 may take any size or dimension as needed to lift and lower the tray 40. As a specific example, in an embodiment, the belt diameter of the pulleys 42, 44 may be approximately 0.5 inches (1.3 centimeters), the outer diameter of the pulleys 42, 44 may be approximately 3 inches (7.6 centimeters), and their pinch diameter may be approximately 3 inches (7.6 centimeters). The pulleys may also be made out of any known materials, such as plastics.

The elastic tubing 46 may be any known tubing that provides resiliency or elasticity for accommodating lengthening or stretching when reams of paper are added, resiliency when paper is removed to lift the tray 40, as well as substantial tension to bias the tray 40 upwardly (e.g., toward the lid 18 or opening 20). For example, latex rubber tubing may be used. Generally, as shown in FIG. 3*a*, tubing 46 is a single line tubing. In an embodiment, the elastic tubing 46 may be a soft tubing. In an embodiment, the tubing 46 may comprise a Shore A durometer of approximately 35.

In an embodiment, tubing 46 may comprise material(s) or configuration(s) such that it may hold tray 40 statically when loaded with paper reams 11 and thus counteract the amount of force for the weight load of the reams 11 provided on the tray 40. For example, the tubing 46 may be designed to provide counteracting forces around approximately forty (40) force-lbs. In an embodiment, tubing 46 may be such that it is sufficient for holding the weight of approximately ten (10) reams of paper 11. For example, the tubing 46 may be configured such that it is able to hold approximately ten paper reams 11 of five hundred (500) count sheet paper, with a paper weight of approximately five (5) pounds. In an embodiment, the tubing 46 may be designed to hold a weight (of paper) of up to approximately sixty (60) pounds.

In an embodiment, the elastic tubing 46 is designed to stretch up to three times its original length (or length while in a resting state) while still providing a resiliency to allow it to conform back to its original shape. Generally, any length of tubing that is required to connect the base 30, tray 40, and pulleys 42, 44 while still providing an bias toward the opening 20 may be used. For example, in an embodiment, the tubing 46 may be designed such that comprises a length within the range of approximately 50-60 inches (127-152.4 centimeters) while in its resting state. In an embodiment, the total length of the tubing 46 in its resting states is approximately 57 inches.

The biased paper dispensing device 10 as described above uses the elastic tubing 46 to bias the paper reams 11 on the lift tray 40 towards the lid 18 or opening 20 for dispensing. However, as noted previously, other, alternative mechanical devices may be used alone or in combination with tubing 46 to provide the required bias and variance needed for the lift tray 40 in the dispensing device 10. For example, in an embodiment, cords, such as bungee cords, may be used in place of (or in combination with) tubing 46. In an embodiment, springs may be also be used to assist or provide bias to the lift tray 40. Generally other known resilient devices that provide bias (and/or variance) to lift the paper reams 11 may be used.

The biased paper dispensing device 10 does not require use of a motor, electro-mechanical device, controller and/or sensors to lift the tray 40. Thus, the bias paper dispensing device 10 does not provide the user with the need to worry about replacement of substantial parts when broken.

The elastic tubing 46 is also advantageous because the tubing 46 itself a resilient mechanism. When the tray 40 is displaced (e.g., so as to extend or stretch the tubing 46), the force applied to the tubing 46 remains substantially more constant through the range of displacement. The displacement of the tubing 46 is spread out over more length and, thus, provides a larger displacement of the tray 40 in the vertical direction with respect to the housing 12. Additionally, because the elastic tubing 46 of tie dispensing device 10 provides its own tension and/or resilience, there is no need for additional resilient mechanisms or springs to be provided with the system. This, in combination with the lack of motor or other devices as noted above, provides all additional advantage in that there are less parts required by the dispensing device 10, and, therefore, a decrease in costs to produce and/or maintain.

It is envisioned that the above biased paper dispensing device 10 may be used to work in correlation with machines such as a printer, copier, facsimile or other multi-function device (MFD). In an embodiment, biased paper dispensing device 10 may be used such that stacks 11 or individual sheets may be withdrawn from the stacks 11 manually or mechanically, for example.

In an embodiment, the channels 56 provided in lift tray 40 may include a clip mechanism (not shown) therein that assist in holding and preventing the elastic tubing 46 from falling out of the channel 56 or being removed therefrom. For example, clip mechanisms may be designed to hold tubing 46 in the tray 40 with respect to its top; however, the clip mechanisms should be designed so as to not inhibit elastic movement or displacement of the tubing 46.

Additionally, in an embodiment, as previously noted above with respect to FIG. 3*a*, a paper guide device 92 as shown in FIG. 5 may be used with the biased paper dispensing device 10. Paper guide device 92 may be used to assist in directing or guiding paper within the elongated body of housing 12, for example. The paper guide device 92 is positioned below the upwardly facing opening 20 and is configured to engage paper on the tray 40 and guide the paper into alignment with the upwardly facing opening 20. More specifically, paper guide device 92 may direct or guide paper (or ream(s)) 11 toward a center of the housing 12 and/or upwardly facing opening 20 in the lid 18 as the paper is pushed or pulled (e.g., in an upward and/or downward direction) in the body of the housing 12 (e.g., due to the addition and/or removal of paper or reams 11). The paper guide device 92 may also assist in directing paper into a center of the tray 40. Thus, paper guide device 92 assists in preventing the paper from catching or sticking to an underside of lid 18, as will become further evident.

Paper guide device 92 may be positioned or mounted with respect to opening 20. Paper guide device 92 may be removably attached to lid 18. For example, vertical extension wall 25*c* of lid 18 may comprise an attachment section 90 for attachment of at least a portion 94 of guide device 92. In an embodiment, attachment section 90 may be in the form of an opening or slot (as shown in FIGS. 3*a* and 5). In an embodiment, the attachment section 90 may be an opening provided in a horizontal configuration (as shown), or, alternatively, section 90 may be provided in a vertical, diagonal or other configurations. In an embodiment, a plurality of attachment sections 90 or openings may be provided as a connection for guide device 92. In another embodiment, attachment section(s) 90 may be extensions or protrusions for connecting with paper guide device 92. Nonetheless, the orientation, shape, and configuration of the attachment section(s) for connecting or attaching the guide device 92 should not be limiting. Additionally, the location (e.g., on the extension 25*c* of lid 18) of the attachment section(s) 90 should not be limiting. For example, the attachment section 90 may be provided in any suitable location for assisting in aligning the paper within the elongated body of housing 12, on the tray 40, or within the opening 20.

In an embodiment, guide device 92 may be permanently attached. In an embodiment, the paper guide device 92 maybe manufactured with the lid 18 (e.g., such as by molding) or formed separately from the lid and later attached (e.g., such as by using adhesive or other products).

As shown in FIG. 5, paper guide device 92 may generally comprises an extension 94 which may be easily insert into attachment section 90 (or opening or slot) thus attaching guide device 92 to the extension wall 25*c* or lid 18. Paper guide device 92 also comprises a wall 96 extending vertically downward from attachment portion 94. The wall 96 is designed to lie substantially along or in line with the extension wall 25*c*. Paper guide device 92 also includes an angled wall 98. Angled wall 98 has a top end 98*b* and a bottom end 98*a*, and generally slopes in a substantially diagonal direction. In some cases, the angled wall 98 generally slopes in a downward direction that is substantially away from the upwardly facing opening 20 of lid 18. That is, the angled wall 98 is positioned such that it extends below the lid 18 and toward the walls of the housing 12. In some cases, the angled wall 98 may be described as sloping upwardly toward the upwardly facing opening 20 (sloping from the inner walls of the housing 12). In any case, the angled wall 98 of the paper guide device 92 assists in directing or guiding the paper into alignment with the opening 20 of the device 10. For example, as paper is raised in an upward direction, the paper 11 may contact bottom end 98*a* and move along the angled wall 98 toward the top end 98*b*, and, therefore, toward a center of the lid 18. Angled wall 98 may be part of a wedge portion 99, also part of the paper guide device 92. Wedge portion 99 may be provided and secured substantially underneath the lid portion 18 and within housing 12 and provide additional stability or guidance of paper reams 11.

FIG. 5 illustrates one exemplary embodiment of a paper guide device 92. As noted above, the orientation, shape, configuration, attachment, or manufacturing of the device should not be limiting.

While the principles of the invention have been made clear in the illustrative embodiments set forth above, it will be apparent to those skilled in the art that various modifications may be made to the structure, arrangement, proportion, elements, materials, and components used in the practice of the invention. For example, the biased paper dispensing device 10 and its parts may be formed any number of ways, such by molding, for example. The device 10 and its parts may also be formed from any number of materials, such as plastics, for example.

Alternatively, in an embodiment, a separate or distinct lid 18 as described above need not be provided. That is, the upper end 14 may be formed or molded such that it provides a substantially similar shape with the ability to house the lift system 38, and/or the ability to attach flanges 22 thereto. Additionally, in some embodiments, base 30 and/or flanges 22 need not be provided.

Though a plurality of pulleys 42, 44 are described as part of the lift system 38, it is noted that any type of structure (such as rods, for example) may be used in the device 10 and for allowing the elastic tubing 46 to be trained thereover and extend downwardly to a connection therebelow. As such, the use of pulleys 42,44 in the lift system 38 should not be limiting.

In some embodiments, the wheels 32 or roller devices may provide directly on the lower part 16 of the housing 12, for example. In an embodiment, the size, location, or angle of the opening 20 in the lid 18 may be altered.

Also, the measurements and weights associated with a ream of paper should not be limited to the examples discussed herein. For example, if the device holds stacks comprising 1000 sheets, it is to be understood that the device, lift system, lid, and opening as described herein may be configured to accommodate the stack (as well as its weight). That is, in some embodiments, the amounts of the stacks and total weight capable of being held by the lift system and tubing, for example, may be adjusted based on the materials/paper to be held in the device. As such, it is to be understood that the size and dimensions of the device, lift system, lid, and opening—and their associated elements—may be adjusted according to the ream or stack of paper to be held therein. Furthermore, the reams and/or stacks of paper to be dispensed and lifted should not be limiting. For example, it is to be understood that it is within the scope of this disclosure that paper of different types, weights, grades, or densities (e.g., bond, cardboard, newsprint, paperboard, etc.), and/or sizes may be used in accordance with one or more embodiments as described herein.

It will thus be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications encompassed within the spirit and scope of the above description.

What is claimed is:

1. A biased paper dispensing device for dispensing paper, the dispensing device comprising:

a housing with an elongated body for containing the paper;

the housing comprising an upwardly facing opening for receiving the paper therein, the opening provided in the upper part thereof and having a generally horizontal orientation;

a lift system provided in the housing comprising a tray and elastic tubing, the lift system configured to move the tray vertically within the elongated body of the housing to allow access to the paper through the opening;

the tray configured to hold the paper horizontally in the housing, the tray being coupled to the elastic tubing; and wherein the elastic tubing extends upwardly from the tray, and is trained over a structure within the housing and extends downwardly to a connection below the structure, and wherein the elastic tubing configured to apply a biasing force to the tray such that the tray is biased toward the opening of the housing.

2. The device according to claim 1, wherein the structure comprises a plurality of pulleys, the plurality of pulleys configured to receive at least a part of the elastic tubing around their perimeters to assist in moving the tray vertically within the housing.

3. The device according to claim 1, wherein the tray comprises at least one opening to allow the elastic tubing to pass therethrough and into the at least one channel.

4. The device according to claim 1, wherein the elastic tubing is positioned to support at least two sides of the tray.

5. The device according to claim 1, further comprising a lid provided on the housing, and wherein the opening is provided in the lid.

6. The device according to claim 5, wherein the lid is configured to house at least a part of the lift system.

7. The device according to claim 2, wherein the plurality of pulleys is housed within a lid provided on the housing, and wherein the upwardly facing opening is provided in the lid.

8. The device according to claim 1, further comprising at least one lateral opening portion, the lateral opening portion permitting paper exposed via upwardly facing opening to be withdrawn laterally therefrom.

9. The device according to claim 5, wherein the lid further comprises flanges that are biased to extend inwardly with respect to the upwardly facing opening and in spaced relation above the upwardly facing opening, the flanges configured to be in contact with an upper surface of paper in the housing to keep the paper in place against the bias of the lift system.

10. The device according to claim 9, wherein the flanges are moveable downwardly to permit paper to be inserted downwardly between the flanges through the upwardly facing opening.

11. The device according to claim 1, wherein the housing further comprises a viewing section along at least one side of the housing so as to provide a window of visibility for an amount of paper provided in the housing.

12. The device according to claim 1, further comprising a base connected to the lower part of the housing, the base having at least one wheel to allow movement of the biased paper dispensing device with respect to a surface.

13. The device according to claim 12, wherein the base has at least one mounting area for securing at least a part of the elastic tubing therein.

14. The device according to claim 1, further comprising a paper guide device positioned below the opening, the paper guide device configured to engage paper on the tray and guide the paper into alignment with the upwardly facing opening.

15. The device according to claim 14, wherein the paper guide device comprises at least one angled wall for directing the paper into alignment with the opening.

16. The device according to claim 1, wherein the housing further comprises a limitation device for limiting movement of the tray within the paper dispensing device.

17. The device according to claim 1, wherein the tray further comprises extension guides extending from the tray for guiding the tray as it moves vertically within the paper dispensing device.

18. A biased paper dispensing device for dispensing paper, the dispensing device comprising:

a housing with an elongated body for containing the paper, the housing having an upwardly facing opening for receiving the paper therein;

a lift system provided in the housing configured to apply a biasing force to the paper such that the paper is biased upwardly toward and through the upwardly facing opening of the housing;

flanges movable between (a) a paper retaining position extending inwardly with respect to the upwardly facing opening and in spaced relation above the upwardly facing opening to enable the flanges to contact an upper surface of paper in the housing to keep the paper in place against the bias of the lift system, and (b) a paper loading positioning extending downwardly to permit paper to be inserted downwardly between the flanges through the upwardly facing opening, the flanges being biased to the paper retaining position, and wherein at least one lateral opening permits paper exposed above the upwardly facing opening to be withdrawn laterally from beneath the flanges in the paper retaining position.

19. The device according to claim 18, wherein the flanges are biased to the paper retaining position by one or more torsion springs.

20. The device according to claim 18, further comprising a paper guide device positioned below the upwardly facing opening, the paper guide device being configured to guide the paper into alignment with the upwardly facing opening.

21. The device according to claim 18, wherein the lift system comprises a tray and elastic tubing, the lift system configured to move the tray vertically within the elongated body of the housing to allow access to the paper through the opening; the tray configured to hold the paper horizontally in the housing, the tray being coupled to the elastic tubing; and wherein the elastic tubing extends upwardly from the tray, and is trained over a structure within the housing and extends downwardly to a connection below the structure, and wherein the elastic tubing configured to apply a biasing force to the tray such that the tray is biased upwardly.

22. The device according to claim 21, wherein the structure comprises a plurality of pulleys, the plurality of pulleys configured to receive at least a part of the elastic tubing around their perimeters to assist in moving the tray vertically within the housing.

23. The device according to claim 21, wherein the elastic tubing is positioned to support at least two sides of the tray.

24. The device according to claim 18, further comprising a lid provided on the housing, wherein the upwardly facing opening is provided in the lid, and wherein the lid is configured to house at least a part of the lift system.

25. The device according to claim 18, wherein the housing further comprises a viewing section along at least one side of the housing so as to provide a window of visibility for an amount of paper provided in the housing.

26. A biased paper dispensing device for dispensing paper, the dispensing device comprising:

a housing with an elongated body for containing the paper, the housing having an upwardly facing opening for receiving the paper;

a lift system provided in the housing comprising a tray and elastic tubing, the tray coupled to the elastic tubing and configured to hold the paper horizontally in the housing, the elastic tubing extending upwardly from the tray, trained over a structure within the housing, and extending downwardly to a connection below the structure, and the elastic tubing configured to apply a biasing force to the tray such that the tray is biased upwardly and the paper is biased toward and through the upwardly facing opening of the housing and configured to move the paper vertically within the elongated body of the housing to allow access to the paper through the upwardly facing opening, and a paper guide device positioned below the upwardly facing opening, the paper guide device being configured to engage paper on the tray and guide the paper into alignment with the upwardly facing opening.

27. The device according to claim 26, wherein the paper guide device comprises at least one angled wall for directing the paper into alignment with the opening.

28. The device according to claim 26, wherein the structure comprises a plurality of pulleys, the plurality of pulleys configured to receive at least a part of the elastic tubing around their perimeters to assist in moving the tray vertically within the housing.

29. The device according to claim 26, wherein the elastic tubing is positioned to support at least two sides of the tray.

30. The device according to claim 26, further comprising a lid provided on the housing, wherein the upwardly facing opening is provided in the lid, and wherein the lid is configured to house at least a part of the lift system.

31. The device according to claim 26, further comprising at least one lateral opening portion, the lateral opening portion permitting paper exposed via upwardly facing opening to be withdrawn laterally therefrom.

* * * * *